US010082155B2

(12) United States Patent
Mikkelsen et al.

(10) Patent No.: US 10,082,155 B2
(45) Date of Patent: Sep. 25, 2018

(54) CENTRIFUGAL PUMP

(71) Applicant: GRUNDFOS HOLDING A/S, Bjerringbro (DK)

(72) Inventors: Steen Mikkelsen, Bjerringbro (DK); Brian Lundsted Poulsen, Langå (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 328 days.

(21) Appl. No.: 14/900,766

(22) PCT Filed: May 15, 2014

(86) PCT No.: PCT/EP2014/059977
§ 371 (c)(1),
(2) Date: Dec. 22, 2015

(87) PCT Pub. No.: WO2014/206638
PCT Pub. Date: Dec. 31, 2014

(65) Prior Publication Data

US 2016/0153469 A1 Jun. 2, 2016

(30) Foreign Application Priority Data

Jun. 24, 2013 (EP) ..... 13173439

(51) Int. Cl.

| | |
|---|---|
| ***F04D 29/42*** | (2006.01) |
| ***F01D 1/06*** | (2006.01) |
| ***F04D 29/62*** | (2006.01) |
| ***F04D 1/06*** | (2006.01) |
| ***F04D 17/08*** | (2006.01) |

(Continued)

(52) U.S. Cl.
CPC ..... *F04D 29/628* (2013.01); *F04D 1/06* (2013.01); *F04D 17/08* (2013.01); *F04D 29/22* (2013.01); *F04D 29/28* (2013.01); *F04D 29/4206* (2013.01); *F04D 29/426* (2013.01); *F04D 29/4266* (2013.01); *F04D 29/624* (2013.01)

(58) Field of Classification Search
CPC ..... F04D 1/06; F04D 29/426; F04D 17/06; F05D 2250/30; F05D 2260/30
See application file for complete search history.

(56) References Cited

U.S. PATENT DOCUMENTS 3,051,090 A * 8/1962 Zumbusch ..... F04D 1/063 415/199.1
4,234,290 A * 11/1980 Lobach ..... B05B 9/0416 415/145

(Continued)

FOREIGN PATENT DOCUMENTS

CN 1140239 A 1/1997
CN 1620556 A 5/2005

(Continued)

*Primary Examiner* — Ninh H Nguyen
(74) *Attorney, Agent, or Firm* — McGlew and Tuttle, P.C.

(57) ABSTRACT

The centrifugal pump (1) includes several pump stages which are arranged axially between a head part (4) and a foot part (2). An outer casing (3) peripherally surrounds the pump stages. An axial end of the outer casing (3) is fastened on the head part and the other axial end of the outer casing (3) is fastened on the foot part. A mechanical connection between the head part (4) and the foot part (2) is formed by the outer casing (3).

19 Claims, 8 Drawing Sheets

(51) Int. Cl.
*F04D 29/22* (2006.01)
*F04D 29/28* (2006.01)

(56) References Cited

U.S. PATENT DOCUMENTS

| | | | | | |
|---|---|---|---|---|---|
| 4,307,995 | A | * | 12/1981 | Catterfeld | F04D 1/06 415/199.1 |
| 5,071,317 | A | | 12/1991 | Leach | |
| 5,888,053 | A | * | 3/1999 | Kobayashi | F04D 1/06 417/244 |
| 2005/0147505 | A1 | | 7/2005 | Kuroiwa et al. | |
| 2009/0274555 | A1 | | 11/2009 | Ouwehand | |
| 2012/0160502 | A1 | * | 6/2012 | Pettigrew | E21B 43/26 166/308.3 |

FOREIGN PATENT DOCUMENTS

| | | | |
|---|---|---|---|
| CN | 101566161 | A | 10/2009 |
| CN | 201568310 | U | 9/2010 |
| DE | 10 15 692 | B | 9/1957 |
| DE | 12 75 866 | B | 8/1968 |
| DE | 35 23 599 | A1 | 1/1987 |
| EP | 0 726 397 | A1 | 8/1996 |
| EP | 1 469 202 | A1 | 10/2004 |
| EP | 2 112 380 | A1 | 10/2009 |
| JP | 62-503181 | A | 12/1987 |
| WO | 8700250 | A1 | 1/1987 |

* cited by examiner

CENTRIFUGAL PUMP

CROSS REFERENCE TO RELATED APPLICATIONS

This application is a United States National Phase Application of International Application PCT/EP2014/059977 filed May 15, 2014 and claims the benefit of priority under 35 U.S.C. § 119 of European Patent Application 13173439.4 filed Jun. 24, 2013 the entire contents of which are incorporated herein by reference.

FIELD OF THE INVENTION

The invention relates to a centrifugal pump with several pump stages.

BACKGROUND OF THE INVENTION

Multi-stage centrifugal pumps are known, with which several pump stages, in each case consisting of a pump impeller and a spiral housing which surrounds this, are arranged between a head part and a foot part, wherein the impellers are arranged on a common shaft. Thereby, the head part and foot part amid the inclusion of the pump stages are connected to one another via outer-lying tie rods in the form of screws.

Such a centrifugal pump typically comprises four screws, which run on the outside along the pump stages. Thereby, embodiments are known, with which the spiral housing in the region of the pump stages form the outer casing or such, with which a fluid return is effected within the housing, typically to the foot part, and which comprise an outer casing which forms an annular channel between the outer sides of the spiral housing and the outer casing, via which annular channel the delivery fluid flows from the head part to the foot part or, as the case may be, also vice versa.

Common to both embodiments is the fact that the screws, with which the head part and foot part are clamped amid the inclusion of the pump stages or, as the case may be, of the outer casing surrounding these, bear in the region of the head part and foot part, but have a certain distance in the region of the pump stages. The latter fact leads to the fact that the temperature of the screws can differ significantly from that of the delivery fluid and thus also that of the spiral housing or of the outer casing, which leads to thermal stresses within the centrifugal pump. Such thermal stresses can also lead to premature wear or failure of the pump.

A further disadvantage of this construction type is the fact that not only the shaft and, as the case may be, the outer casing must be provided in different lengths depending on the number of pump stages, but also that the screws connecting the head part and foot part must be provided in different lengths, in order depending on the number of pump stages, to connect the head part and foot part amid the inclusion of the pump stages.

SUMMARY OF THE INVENTION

Against this background, it is an object of the invention to provide a multistage centrifugal pump which on the one hand avoids, or at the minimum reduces thermal stresses within the pump, and on the other hand the variety of components is reduced with the construction of construction series having a different stage number.

The centrifugal pump according to the invention comprises several pump stages which are arranged axially between a head part and a foot part. It furthermore comprises an outer casing which peripherally surrounds the pump stages. According to the invention, an axial end of the outer casing is fastened on the head part, and the other axial end on the foot part of the centrifugal pump, wherein the mechanical connection between the head part and foot part is formed by the outer casing.

The basic concept of the solution according to the invention is thus to utilize the outer casing which as a rule is present in any case, for clamping the pump stages between the head part and foot part. The outer casing thus forms the mechanical connection between the head part and the foot part. The axial ends of the outer casing therefore according to the invention are fixedly, preferably however releasably fastened on the foot part and on the head part, in a direct or indirect manner. The otherwise necessary tie rods can be done away with in this manner. The outer casing, if this forms the annular return channel within the centrifugal pump, is always subjected to the temperature level of the delivery fluid, so that thermal stresses are largely avoided, since the outer casing and pump stages as well as head part and foot part always have the same temperature level. With embodiments which comprise the outer casing only for fastening purposes, with which therefore no annular channel is formed, the outer casing is usefully designed bearing on the pump stages, i.e. on the outer side of the spiral housing, in order where possible to create a thermally conductive connection to these.

Thereby, in the simplest form, the outer casing can have a cylindrical shape and be radially clamped in the head part and foot part or be firmly connected to the head part or foot part via essentially radially arranged screws. These screws can for example be led through corresponding bores which are arranged distributed over the periphery of the outer casing at its end, and be fixed in the head part or foot part. Preferably however, the outer casing at its axial ends is designed in a radially widened manner, since a fastening which is simple and effective to the same extent is possible by way of this, and on the other hand the assembly is very simple, since a funnel-like receiver results, which permits a simple assembly on the outer periphery of the pump stages.

Such a widened axial end of the outer casing is advantageously fastened on the head part or on the foot part via a flange which engages over. The widening of such an outer casing which is typically formed from sheet metal is simple with regard to manufacturing technology and at the same time in combination with the flange fastening permits a uniform introduction of force over the whole periphery, which is particularly advantageous. With this arrangement, the outer casing can also be formed from non-metallic materials such as fibre composite materials for example.

Thereby, the flange connection is preferably designed such that the connection between the outer casing and the head part or foot part is effected with a non-positive as well as positive fit. Thereby, the positive fit provides a high security against a failure of the connection, whereas the non-positive fit ensures that the forces are introduced uniformly over the periphery and as a rule no further securing means preventing a release of the connection need to be provided.

The axial ends of the outer casing can be designed in a conically widened manner, and then however corresponding cones are to be provided on the head part or foot part as well as on the flange side. Inasmuch as this is concerned, it can therefore be more favorable to widen the axial ends of the outer casing in a step-like manner, so that either only a flange-like, essentially radially running ring arises at each end of the outer casing or however preferably a true step, i.e. a casing section which connects to the flange-like ring and which runs essentially parallel to the remaining outer casing. Such a true step-like design can accommodate particularly high tensile forces, even if the radial extension of the flange-like section is only comparatively small. It is to be understood that then a corresponding step should be provided in the head part or in the foot part of the centrifugal pump as well as in the flange, in order to be able to support and clamp the respective axial end.

The flange which engages over the axial end of the outer casing and which is advantageously designed as an annular loose flange preferably comprises a first contact surface which bears on the widened axial end of the outer casing, and a second contact surface which bears on the head part or on the foot part. A uniform and secure force introduction into the respective components can be effected via these contact surfaces.

Advantageously, a fastening of a flange is effected via recesses in the flange, through which fastening means are led, with which fastening means the flange is fixed on the head part or on the foot part. Cap screws are typically provided for this, which engage through recesses in the flange and engage into corresponding threaded bores in the head part or the foot part.

In particular, if the axial ends of the outer casing are designed in a radially widened manner, it is useful to form such a loose flange for fastening on the head part or foot part, out of at least two flange parts, since otherwise the fastening flange must be assembled before forming the last widening on the outer casing, which is rather unfavorable with regard to manufacturing and assembly technology. In contrast, with a multi-part, in particular two-part flange, it is possible to attach this in a manner encompassing the outer casing, not until on assembly of the centrifugal pump. It is thereby particularly advantageous with regard to assembly technology, if a flange is formed from two or more identically shaped flange parts.

Thereby, according to an advantageous further development of the invention, the at least two flange parts are designed in an overlapping manner at their ends, wherein recesses aligned to one another are provided in the overlapping region for leading through fastening means. In this manner, e.g. with a screw which passes through such recesses in the overlapping region, the fastening of the flange in this region as well as the fastening of the flange parts to one another can be effected, which is particularly advantageous also with regard to the force introduction of the flange connection. The flange or the flange parts are advantageously designed as cast parts. Since they must typically accommodate high forces, the flanges or the flange parts are manufactured from metal, in particular rust-free stainless steel.

Alternatively, the flange can also be formed of several flange parts which are formed from sheet metal and which in the region of recesses, thus where the screw fastening is effected, are reinforced by support parts preferably likewise consisting of sheet metal. These sheet metal parts including the support parts are advantageously designed as punched parts and are connected to one another by welding for example, thus can be manufactured particularly inexpensively on a large scale and are preferably manufactured of stainless steel.

Instead of a flange connection, according to the invention, alternatively the fastening of the radially widened part of the outer casing onto a radially projecting and peripherally extending bead on the head part and/or foot part is envisaged, and specifically by way of a clamping ring which has an essentially u-shaped cross section and engages around the widened part at the end of the outer casing as well as around the bead, and in this manner fixes the outer casing on the bead of the head part or foot part. Thereby, the peripheral bead is advantageously designed in a manner stepped to the casing, and in a manner such that the radially widened end of the casing can be integrated into the stepping in a flush manner, in order to be fixed on the bead with a positive fit by way of a clamping ring which is U-shaped in cross section. Such an open clamping ring is peripheral by almost 360 and at its ends is provided with a clamping device, for example a clamping screw, with which the distance of the ring ends to one another can be changed. Such a clamping ring is firstly opened so far that it can be pushed over the bead and the widened end of the outer casing, whereupon the clamping ring is tensioned by a reduction of the distance of the ring ends and this, amid the inclusion of the widened out end of the outer casing and the bead, bears on these components and thus firmly connects the outer casing to the head part or foot part.

The fastening means, with which at least one flange is connected to the head part or the foot part of the centrifugal pump, are advantageously designed as screws which are arranged in the axial direction and engage in a correspondingly running threaded bore in the head part or foot part. The fastening can however also be effected via other means, for example via a peripheral clamping ring which is c-shaped in cross section and which on the one hand engages around the flange and a corresponding head-side or foot-side bead on the other hand, or via suitable clips.

The outer casing of the centrifugal pump according to the invention is advantageously manufactured of sheet metal, preferably of rust-free, stainless steel sheet.

With regard to design, the centrifugal pump according to the invention is advantageously formed such that a fluid entry of the pump is arranged at the head part or on the foot part and a fluid exit of the pump is arranged at the head part or on the foot part and that an annular channel for leading the delivery fluid is formed between the outer walls of the pump stages and the outer casing. By way of this, on the one hand it is possible to design the centrifugal pump as an inline pump or at least to arrange the pressure nozzle and suction nozzle on the foot part or as the case may be, also on the head part. This arrangement moreover ensures an almost uniform heat distribution over all components.

The invention is hereinafter explained in more detail by way of embodiment examples which are represented in the drawing. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
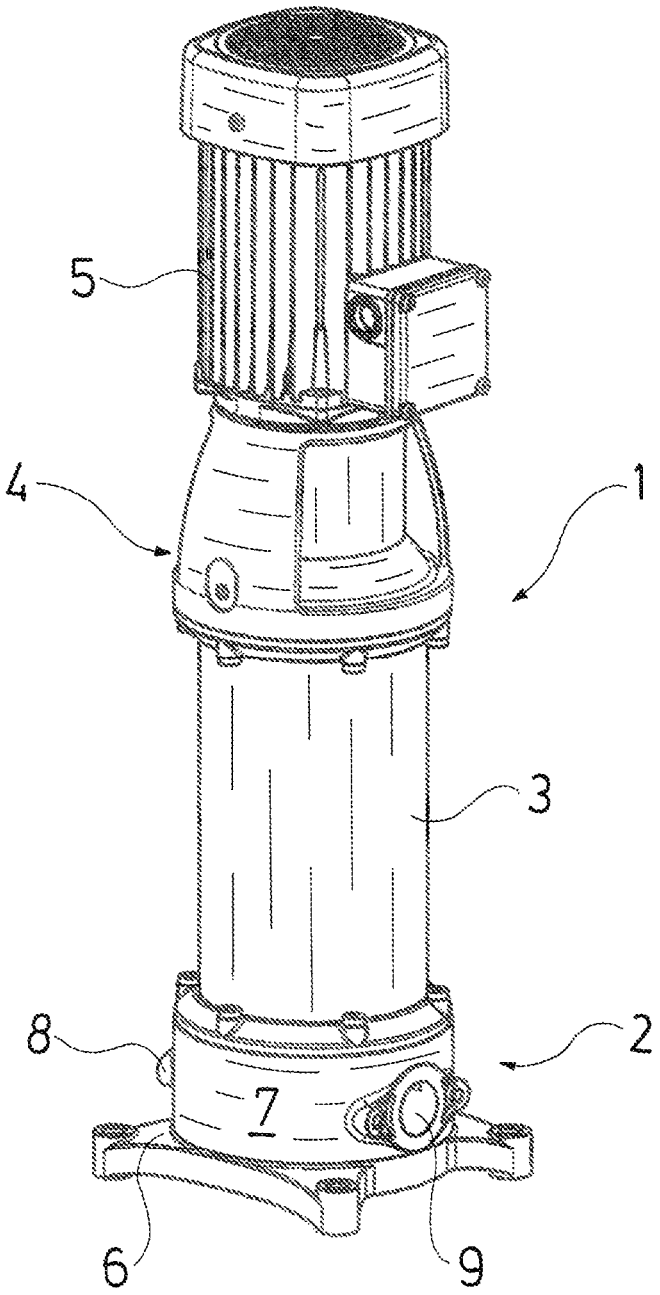
FIG. 1 is a greatly simplified perspective view showing a centrifugal pump with a drive motor.

With regard to the represented centrifugal pump 1, it is the case of a multi-stage inline pump. The centrifugal pump 1 is envisaged for upright operation and it comprises a foot part 2, to which an outer casing 3 connects to the top, the upper end of said outer casing being received by a head part 4 which simultaneously forms a motor base for the electrical drive motor 5 arranged thereabove. The construction of the pump represented in FIG. 1 corresponds to the basic construction of such vertical, multistage high pressure centrifugal pumps of the inline construction manner, as are manufactured and offered for example by the company Grundfos under the type description CR or CRE.

The foot part 2 consisting of cast metal comprises a lower plate 6 which is formed with this as one piece, forms the actual foot of the centrifugal pump 1 and with which the centrifugal pump 1 stands on the base and can be screw-fastened to the base via bores located in the plate 6. The foot part 2 moreover has the shape of a cylindrical tube 7 with a vertical axis which on its outer periphery comprises two connection flanges 8 and 9 which are arranged lying opposite and away from one another, of which one forms the suction connection and the other the pressure connection of the pump 1. The fluid to be delivered gets via the suction connection into the foot part 2 and from there in a consecutive manner into the pump stages which connect vertically thereto and in each case consist of spiral housing and an impeller. Thereby, the arrangement is such that the exit of a lower spiral housing is conductively connected to the entry of the pump stage lying thereabove, and the exit of the last, i.e. the uppermost pump stage is connected via an annular channel to the pressure connection in the foot part 2. The annular channel on the one hand is delimited by the peripheral sides of the spiral housing which is not visible in FIG. 1 and on the other hand by the outer casing 3 which is cylindrical in this region. The impellers of all pump stages are seated on a common shaft which is driven by the drive motor 5 arranged on the head part 4 of the centrifugal pump 1.

Even if the present invention is described by way of a vertical, multi-stage centrifugal pump, it is however not restricted to the vertical arrangement.

Figure 2:
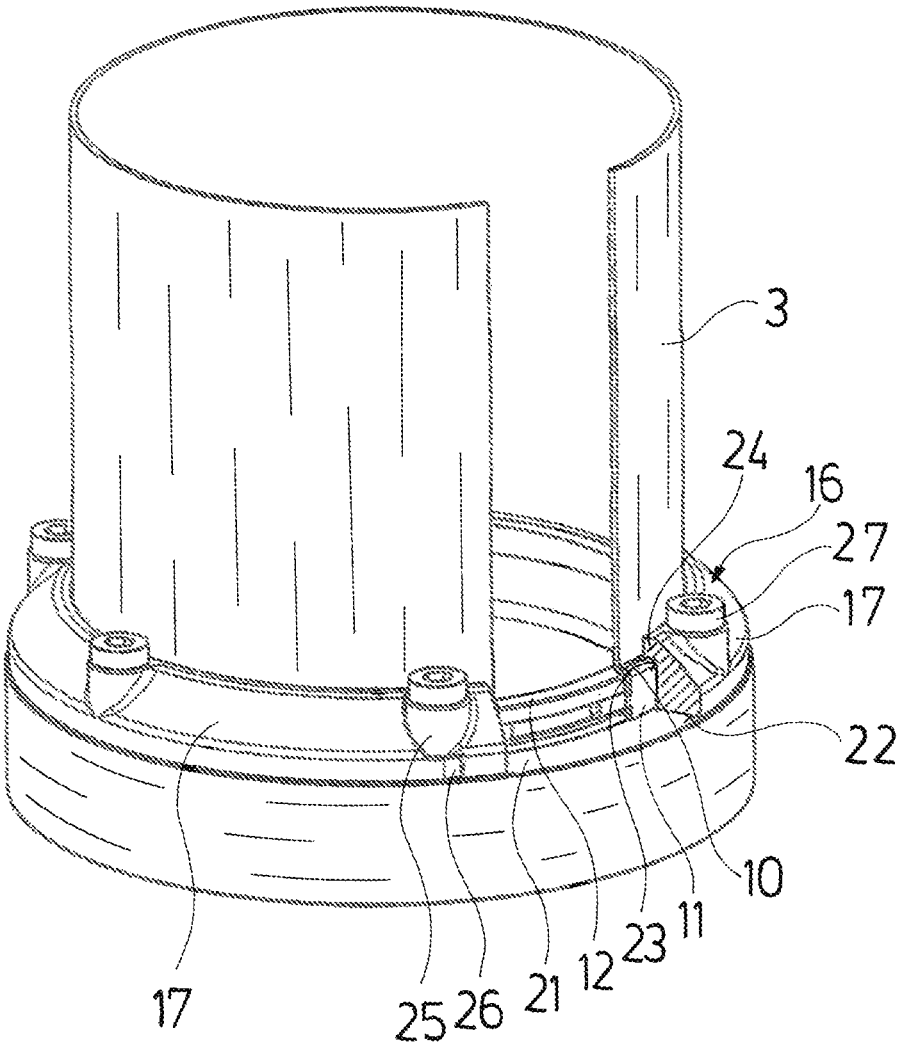
FIG. 2 is a greatly simplified, enlarged, partly sectioned perspective view showing a transition region between the foot part and the outer casing of the pump according to FIG. 1.
Figure 3:
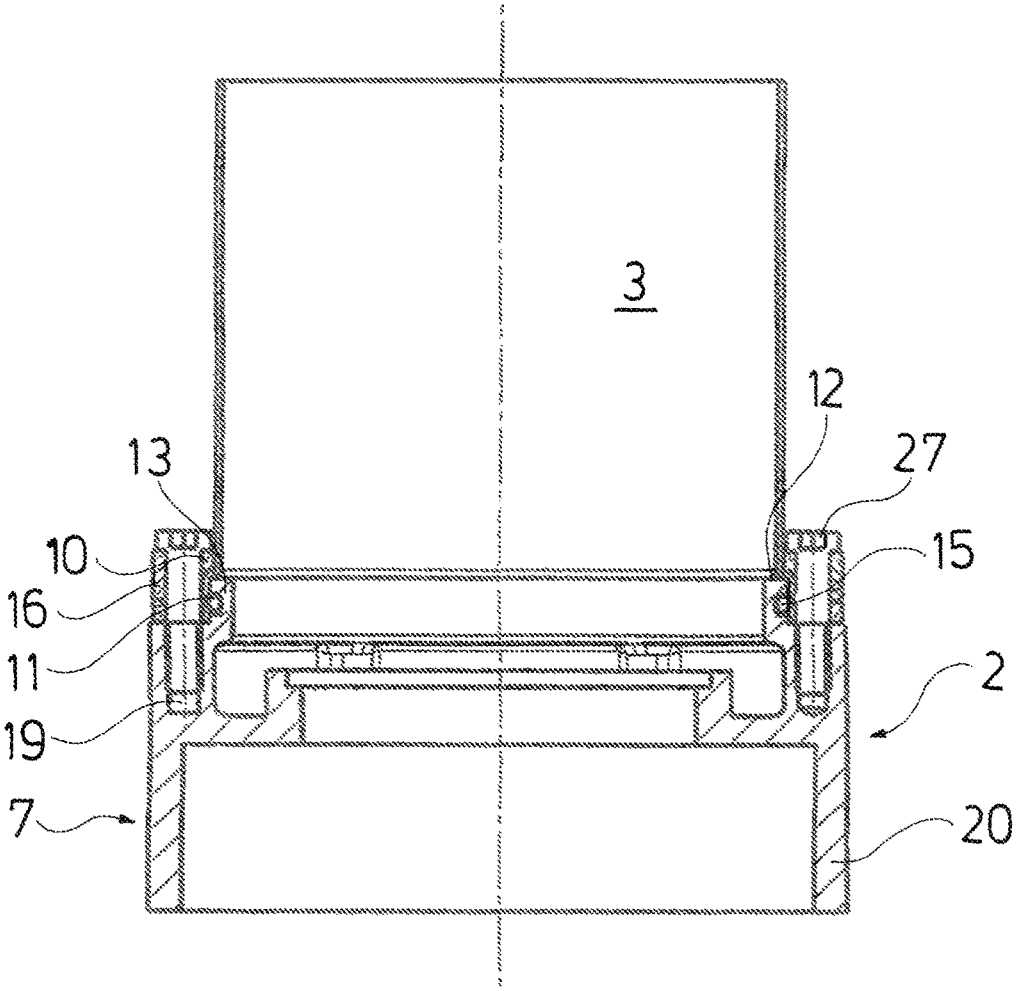
FIG. 3 is a longitudinal sectional view of the part perspectively represented in FIG. 2.

The mechanical connection between the head part 4 and the foot part 2 with the represented centrifugal pump 1 is effected via the outer casing 3. The outer casing 3 arranged coaxially to the rotation axis and the shaft of the centrifugal pump has the shape of a cylindrical tube but is designed radially widened in a step-like manner at the axial ends. Such a widening consists of a flange-like, radially outwardly extending flange section 10 as well as of an annular casing section 11 which connects thereto, runs parallel to the remaining outer casing 3 and has a greater diameter than the remaining casing 3. The connection between the step-like end section of the outer casing 3 and the foot part 2 is represented by way of FIGS. 2-4 which show the axial lower end of the outer casing 3 which is connected to the foot part 2. It is to be understood that the axial upper end of the outer casing 3 as well as the connection in the head part 4 are designed in a corresponding manner, but rotated by 180 to the top in the representation.

The radially running flange section 10 on the lower end of the outer casing 3 bears on a correspondingly radially i.e. in the operating position represented in FIG. 1, horizontally arranged annular end face 12 of a cylindrical, vertical projection 13 of the foot part 2. A peripheral groove 14, in which an O-ring 15 is integrated, is arranged in the outer peripheral surface of the projection 13. The outer peripheral surfaces of the projection 13 as well as of the O-ring 15 form a contact surface, with which the inner side of the casing section 11 of the outer casing 3 sealingly bears on the projection 13.

A loose flange 16 which consists of two identical flange parts 17 in the form of flange halves is provided for fastening this widened end section 10, 11 of the outer casing 3 on the foot part 2. Each flange part 17 engages around the outer casing 3 by about 180. The two flange parts 17 together form a closed ring with in total six recesses in the form of vertical bores 18. These bores 18 are aligned with pocket hole bores 19 which are located therebelow, are provided with inner threads and are in a cylindrical tube section 20 which is arranged coaxially to the middle longitudinal axis of the pump 1 and in the inner region is continued to the top by the projection 13. The pocket hole bores 19 are admitted in an annular end face 21 which radially surrounds the projection 13 to the outside.

The loose flange 16 formed from the two flange parts 17 in cross section to the inside has a stepped shape, and to the outside a shape conically tapering to the top, and is reinforced in the region of the bores 18 and provided with an plane end face to the top. As is to be particularly deduced from FIGS. 2 and 3, the loose flange 16 with its plane lower side 22 lies on the end face 21 of the tube section 20. The loose flange 16 moreover comprises a radial inner side 23, with which it bears on the outer side of the casing section 11. Moreover, the loose flange 16 further comprises a radially inwardly directed projection 24, with which it engages over the flange section 10 of the outer casing 3. The lower side of this radial projection 24 lies on the upper side of the flange section 10. The radial inner side of the projection 24 bears on the outer casing 3 with little play. The axially widened end of the outer casing 3 which consists of the flange section 10 and the casing section 11 is thus integrated between the projection 13 and the loose flange 16 with a positive fit and non-positive fit, so that a uniform force introduction is effected over the whole periphery between the foot part 2 and the outer casing 3. The fastening of the other axially widened end of the outer casing 3 on the head part 4 is realized in an analogous manner.

Figure 4:
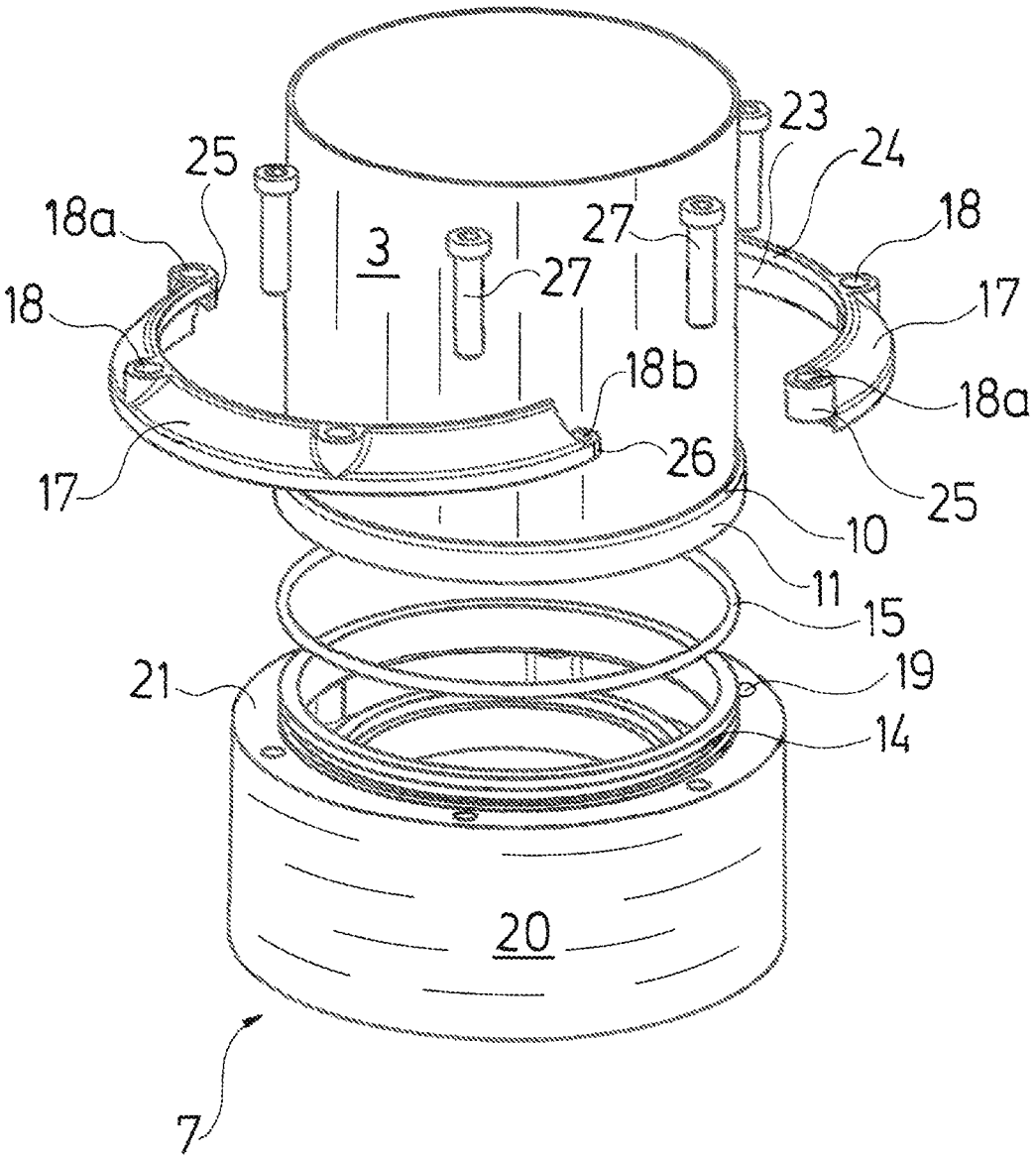
FIG. 4 is an exploded representation of the part represented in FIG. 2.

The loose flange 16 formed from two identical flange halves 17, as is shown in FIG. 4, comprises two sections 25, specifically an upper section 25 and a lower section 26, which overlap in the installed condition. The upper section 25 arranged in each case on the end of each flange part 7 which is arranged on the left side seen from the middle longitudinal axis of the pump, in the installed condition has a distance to the end face 21, whereas the lower section 26 which is provided on the right-side end merges into the plane lower side 22 of the loose flange 16 in a flush manner and fills the free space forming the upper section 25 to the end face 21. Both sections 25 and 26 have a bore 18 which is axial in the installed condition, and specifically the upper section 25 a bore 18*a* and the lower section 26 a bore 18*b*, which together form a bore 18. The sections 25 and 26 in the installed condition lie above one another in pairs, wherein their bores 18*a* and 18*b* are aligned with the pocket hole bore 19 lying therebelow, in the tube section 20. The flange is fastened with screws 27, whose screw heads lie on the upper side of the flange 16 peripherally of the bores 18, whereas the shanks pass through the bores 18 and engage into the pocket hole bores 19 provided with the thread. Thus, the screw 27 also secures the flange parts 17 from releasing from one another, in the region of the overlapping sections 25 and 26. Thus, as a whole an annular and closed loose flange 16 results.

Figure 5:
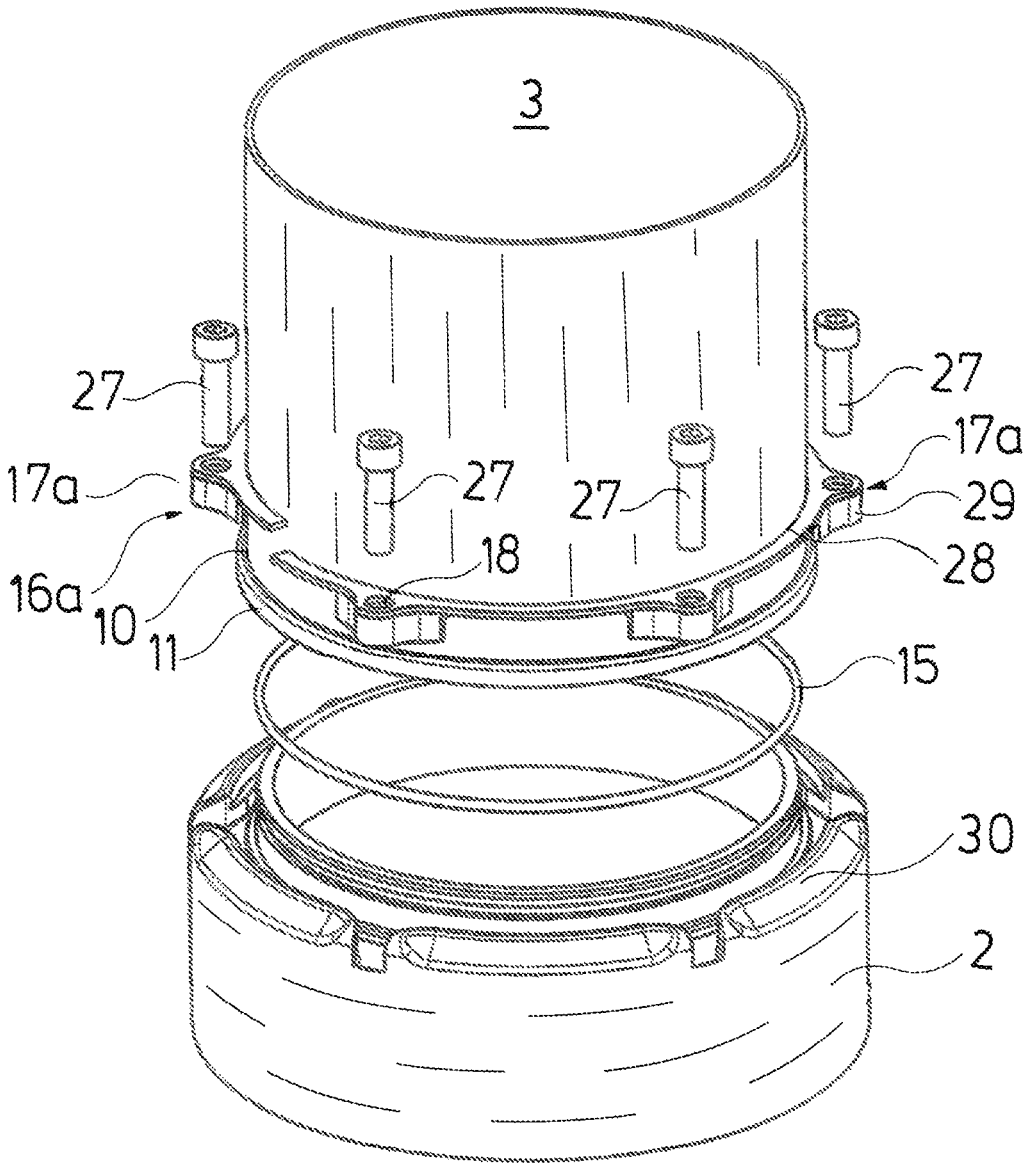
FIG. 5 is an exploded representation corresponding to FIG. 4, showing an alternative flange fastening.
Figure 6:
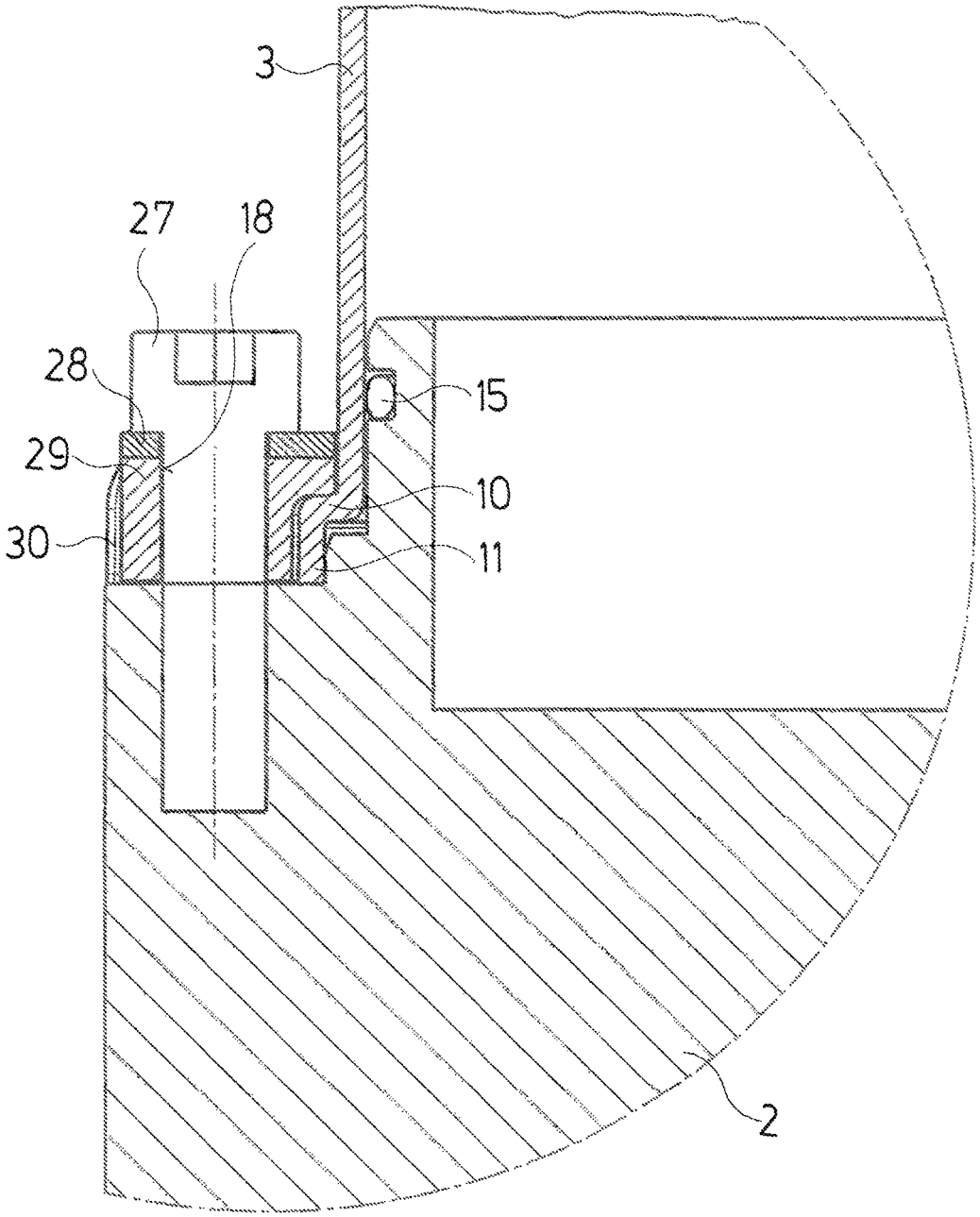
FIG. 6 is a greatly enlarged sectioned representation showing the fastening of the flange represented in FIG. 5, in the region of the screw.

With regard to the embodiment represented by way of FIGS. 5 and 6, the outer casing 3 at the end side is designed in the same manner, but there a two-part loose flange 16*a* is provided and this consist of two identical flange halves 17*a*. The flange halves in each case consist of semi-ring-shaped sheet metal section 28 which in the region of the bores 18 is designed in a reinforced manner by way of support parts 29 likewise consisting of sheet metal. The sheet metal section 28 as well as the support parts 29 are formed as punched parts of stainless steel sheet and are welded to one another for their permanent connection. Here too, the radially widened end of the outer casing 3 is fastened by way of the loose flange 16*a* and by way of fastening screws 27 which are led through the bores 18. On the foot part side however, a groove-like axial deepening is provided, whose outer wall 30 is recessed in the region around the bores 18, thus where the support parts 29 come to bear. The loose flange 16*a* here therefore lies within a groove-like deepening and is surrounded and supported by the outer groove wall. The O-ring 15 for sealing is arranged in a similar manner as with the described embodiments.

Figure 9:
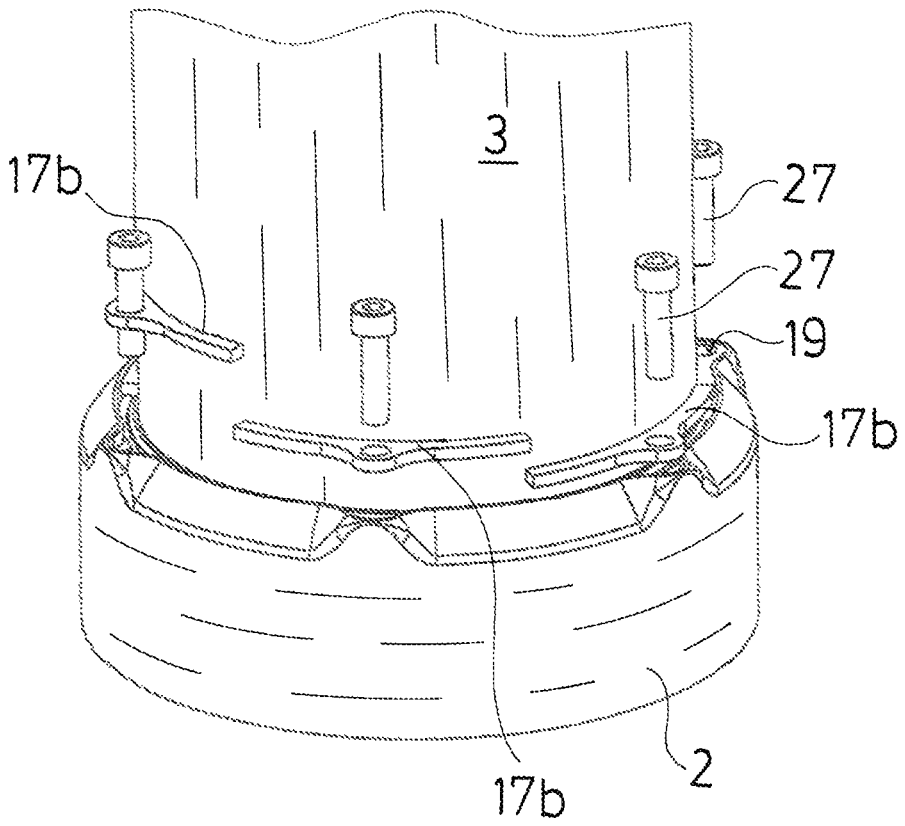
FIG. 9 is an alternative flange design in an exploded representation similar to FIG. 4.

One embodiment is shown by way of FIG. 9, and this corresponds essentially to the previously described ones, with which however the loose flange consists of in total six identical flange parts 17*b* which are fastened in each case with a screw 27 in a bore 19 in the face side of the foot part 2. These flange parts 17*b* are manufactured as punched parts from sheet metal and are particularly inexpensive in manufacture.

Figure 7:
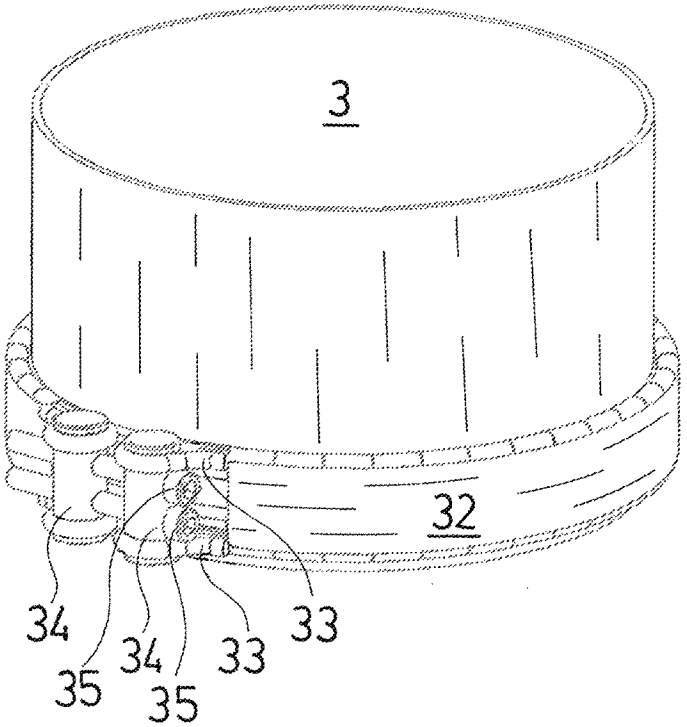
FIG. 7 is a perspective representation showing a clamping ring fastening.
Figure 8:
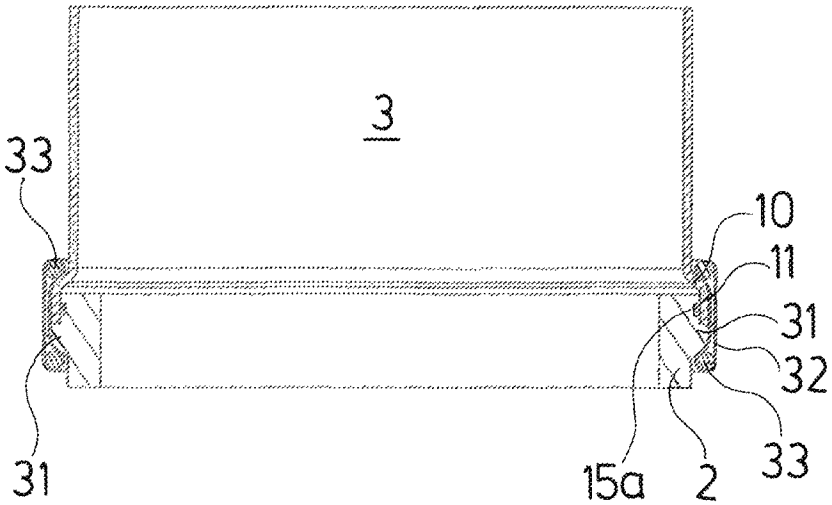
FIG. 8 is a longitudinal sectional view through the components in the region of the clamping ring fastening.

With the embodiment represented by way of FIGS. 7 and 8, the foot part 2 comprises a peripheral bead 31 which, as is to be deduced from FIG. 8, is stepped and is designed tapering to the top, so that the radially widened part at the end of the outer casing 3 can be received in an aligned or flush manner. The radially widened part corresponds essentially to the previously described one, i.e. a casing section 11 is provided which runs parallel to the outer casing 3 but has a greater diameter, as well as a flange section 10 which however with this embodiment does not run perpendicularly to the outer casing, but obliquely thereto. The sealing here is effected in the bead region, and specifically via an O-ring 15*a* which bears on the inner side of the casing section 11.

The fastening of the components is effected via a clamping ring 32 which has a roughly U-shaped cross-sectional shape and engages around the peripheral bed 31 with the widened end of the outer casing 3, with a positive fit. The clamping ring 32 is formed from sheet metal and comprises two reinforcement wires 33 which are integrated into the clamping ring 32 and are fastened on bearing bodies 34 which can be adjusted in their distance to one another via two clamping screws 35.

For assembling the clamping ring 32, the clamping screws 35 are set such that the bearing bodies 34 have a maximal distance, i.e. the clamping ring 32 is tensioned open and can thus be pushed over the bead 31 and the radially widened end of the outer casing 3. Subsequently, the clamping screws 35 are tightened until the clamping ring 32 engages around the end of the outer casing 3 and the foot part 2 on the other side of the bead in a firm manner and thus connects the components inserted therein to one another.

The connections between the outer casing 3 and the foot part 2 described above are here only described by way of example and by way of the foot part 2 and are effected in the same manner at the head part 4. Connections of a different construction type can also be provided on the foot part 2 and the head part 4.

While specific embodiments of the invention have been shown and described in detail to illustrate the application of the principles of the invention, it will be understood that the invention may be embodied otherwise without departing from such principles.

The invention claimed is:

1. A centrifugal pump comprising:

a head part;

a foot part;

several pump stages which are arranged axially between the head part and the foot part;

an outer casing which peripherally surrounds the pump stages, wherein an axial end of the outer casing is fastened on the head part and another axial end of the outer casing is fastened on the foot part, wherein a mechanical connection between the head part and the foot part is formed by the outer casing, wherein the outer casing comprises widened axial ends; and a flange wherein one of the widened axial ends of the outer casing is fastened by the flange engaging over this end, on the head part or the foot part, the flange comprising at least two flange parts, the flange being formed from at least two identically shaped flange parts.

2. A centrifugal pump according to claim 1, wherein the axial ends of the outer casing are non-positively as well as positively fastened at least one of on the head part and on the foot part, by way of the flange.

3. A centrifugal pump according to claim 1, wherein the axial ends of the outer casing are widened stepwise.

4. A centrifugal pump according to claim 1, wherein the flange comprises a first contact surface and a second contact surface, and that the first contact surface bears on the widened axial end of the outer casing, and the second contact surface bears one of on the head part and on the foot part.

5. A centrifugal pump according to claim 1, wherein the flange is an annular loose flange.

6. A centrifugal pump according to claim 1, wherein the flange comprises recesses for leading through fastening means.

7. A centrifugal pump according to claim 1, wherein the at least two flange parts overlap at ends and in the overlapping region comprise recesses which are aligned to one another, for leading through fastening means.

8. A centrifugal pump according to claim 1, wherein at least parts of the flange are manufactured of cast metal rust-free stainless steel.

9. A centrifugal pump according to claim 1, wherein at least parts of the flange are manufactured of sheet metal which are reinforced in the region of recesses by support parts comprised of sheet metal.

10. A centrifugal pump according to claim 1, wherein the flange is screwed one of to the head part and to the foot part of the centrifugal pump in the axial direction.

11. A centrifugal pump according to claim 1, wherein the outer casing is manufactured from rust-free stainless steel sheet.

12. A centrifugal pump according to claim 1, wherein:

a fluid entry of the pump is arranged one of on the foot part and on the head part and a fluid exit of the pump is arranged one of on the foot part and on the head part; and a channel for leading the delivery fluid is formed between an outer wall of the pump stages and the outer casing.

13. A centrifugal pump according to claim 1, wherein the pump is configured as an inline pump with pump stages;

a fluid entry and a fluid exit are arranged on the foot part; and a pressure channel for leading the fluid from the pressure side of the last pump stage to the fluid exit is provided between an outer wall of the pump stages and the outer casing.

14. A centrifugal pump, comprising:

a head part;

a foot part;

several pump stages which are arranged axially between the head part and the foot part; and an outer casing which peripherally surrounds the pump stages, wherein an axial end of the outer casing is fastened on the head part and another axial end of the outer casing is fastened on the foot part, wherein a mechanical connection between the head part and the foot part is formed by the outer casing, wherein the outer casing comprises widened axial ends, wherein:

a radially projecting peripheral bead is provided at least one of on the head part and on the foot part; and the radially widened part at the axial end of the casing is fixed on the bead by way of a peripheral clamping ring.

15. A centrifugal pump according to claim 14, wherein the clamping ring has a u-shaped cross section with limbs that engage with a positive fit behind the radially widened end of the casing on the one hand and the bead on the other hand.

16. A centrifugal pump according to claim 14, wherein the bead includes stepwise changing shape, wherein the radially widened end of the casing is integrated into the stepping in a flush manner.

17. A centrifugal pump comprising:

a head part;

a foot part;

several pump stages which are arranged axially between the head part and the foot part; and an outer casing which peripherally surrounds the pump stages, wherein an axial end of the outer casing is fastened on the head part and another axial end of the outer casing is fastened on the foot part, wherein a mechanical connection between the head part and the foot part is formed by the outer casing, wherein the outer casing comprises widened axial ends, wherein the axial ends of the outer casing are widened stepwise.

18. A centrifugal pump comprising:

a head part;

a foot part;

several pump stages which are arranged axially between the head part and the foot part; and an outer casing which peripherally surrounds the pump stages, wherein an axial end of the outer casing is fastened on the head part and another axial end of the outer casing is fastened on the foot part, wherein a mechanical connection between the head part and the foot part is formed by the outer casing, wherein the outer casing comprises widened axial ends, wherein a fluid entry of the pump is arranged one of on the foot part and on the head part and a fluid exit of the pump is arranged one of on the foot part and on the head part, wherein a channel for leading the delivery fluid is formed between an outer wall of the pump stages and the outer casing.

19. A centrifugal pump comprising:

a head part;

a foot part;

several pump stages which are arranged axially between the head part and the foot part; and an outer casing which peripherally surrounds the pump stages, wherein an axial end of the outer casing is fastened on the head part and another axial end of the outer casing is fastened on the foot part, wherein a mechanical connection between the head part and the foot part is formed by the outer casing, wherein the outer casing comprises widened axial ends, the pump being configured as an inline pump with pump stages, wherein a fluid entry and a fluid exit are arranged on the foot part, wherein a pressure channel for leading the fluid from the pressure side of the last pump stage to the fluid exit is provided between an outer wall of the pump stages and the outer casing.

* * * * *